US006929229B1

(12) United States Patent
Palmby

(10) Patent No.: US 6,929,229 B1
(45) Date of Patent: Aug. 16, 2005

(54) CUP HOLDING ASSEMBLY

(76) Inventor: Chris D. Palmby, 1107 Carolina St., Bellingham, WA (US) 98229

( * ) Notice: Subject to any disclaimer, the term of this patent is extended or adjusted under 35 U.S.C. 154(b) by 0 days.

(21) Appl. No.: 10/739,982

(22) Filed: Dec. 19, 2003

(51) Int. Cl.[7] ..... A47K 1/08
(52) U.S. Cl. ..... 248/311.2; 248/299.15; 248/314
(58) Field of Search ..... 248/314, 311.2, 248/229.1, 229.15, 229.25, 228.6, 231.7, 248/316.1

(56) References Cited

U.S. PATENT DOCUMENTS 3,262,666 A * 7/1966 Solum ..... 248/231.71
3,734,439 A 5/1973 Wintz
4,535,921 A * 8/1985 Sanders ..... 223/106
5,106,046 A * 4/1992 Rowles et al. ..... 248/311.2
5,190,257 A 3/1993 Gradei et al.
D369,526 S 5/1996 Colton
5,842,671 A 12/1998 Gibbs
5,938,160 A * 8/1999 Hartmann et al. ..... 248/311.2
5,996,957 A 12/1999 Kurtz
6,039,206 A 3/2000 DeFrancesco
6,505,802 B2 * 1/2003 Fowler ..... 248/311.2
2004/0084576 A1 * 5/2004 Khan ..... 248/118

* cited by examiner

*Primary Examiner*—Ramon O Ramirez

(57) ABSTRACT

A cup holding assembly for supporting a coffee cup and the like on the edge of a tabletop includes a container having a bottom wall and a peripheral wall that is attached to extends upwardly from the bottom wall. The peripheral wall includes a front wall, a back wall, and a pair of lateral walls. The peripheral wall has an upper edge and a lower edge. A bracket is attached to and extends away from the peripheral wall. The bracket is adapted for removably attaching the container to an edge of a tabletop. The bracket is positioned on the back wall and is positioned adjacent to the upper edge.

4 Claims, 3 Drawing Sheets

CUP HOLDING ASSEMBLY

BACKGROUND OF THE INVENTION

1. Field of the Invention

The present invention relates to cup holding devices and more particularly pertains to a new cup holding device for supporting a drinking vessel on the edge of a tabletop.

2. Description of the Prior Art

The use of cup holding devices is known in the prior art. U.S. Pat. No. 5,996,957 includes a rotational support assembly for adjusting the angle of a drinking cup being held therein. Another type of cup holding device is U.S. Pat. No. 5,842,671 which includes a support adapted for holding a drinking cup above a surface to which the device is attached. Yet another drinking cup holding device is U.S. Pat. No. 5,190,257 which depicts drinking cup holding device which is attachable to a tubular member.

While these devices fulfill their respective, particular objectives and requirements, the need remains for a device that allows a person to support a drinking container, and in particular a coffee cup, to the edge of a tabletop such that the coffee cup is positioned away from the tabletop. Such a construction will allow a user of the device to increase the useful surface area of the tabletop while also preventing the spillage of the contents of the coffee cup.

SUMMARY OF THE INVENTION

The present invention meets the needs presented above by generally comprising a container having a bottom wall and a peripheral wall that is attached to extends upwardly from the bottom wall. The peripheral wall includes a front wall, a back wall, and a pair of lateral walls. The peripheral wall has an upper edge and a lower edge. A bracket is attached to and extends away from the peripheral wall. The bracket is adapted for removably attaching the container to an edge of a tabletop. The bracket is positioned on the back wall and is positioned adjacent to the upper edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
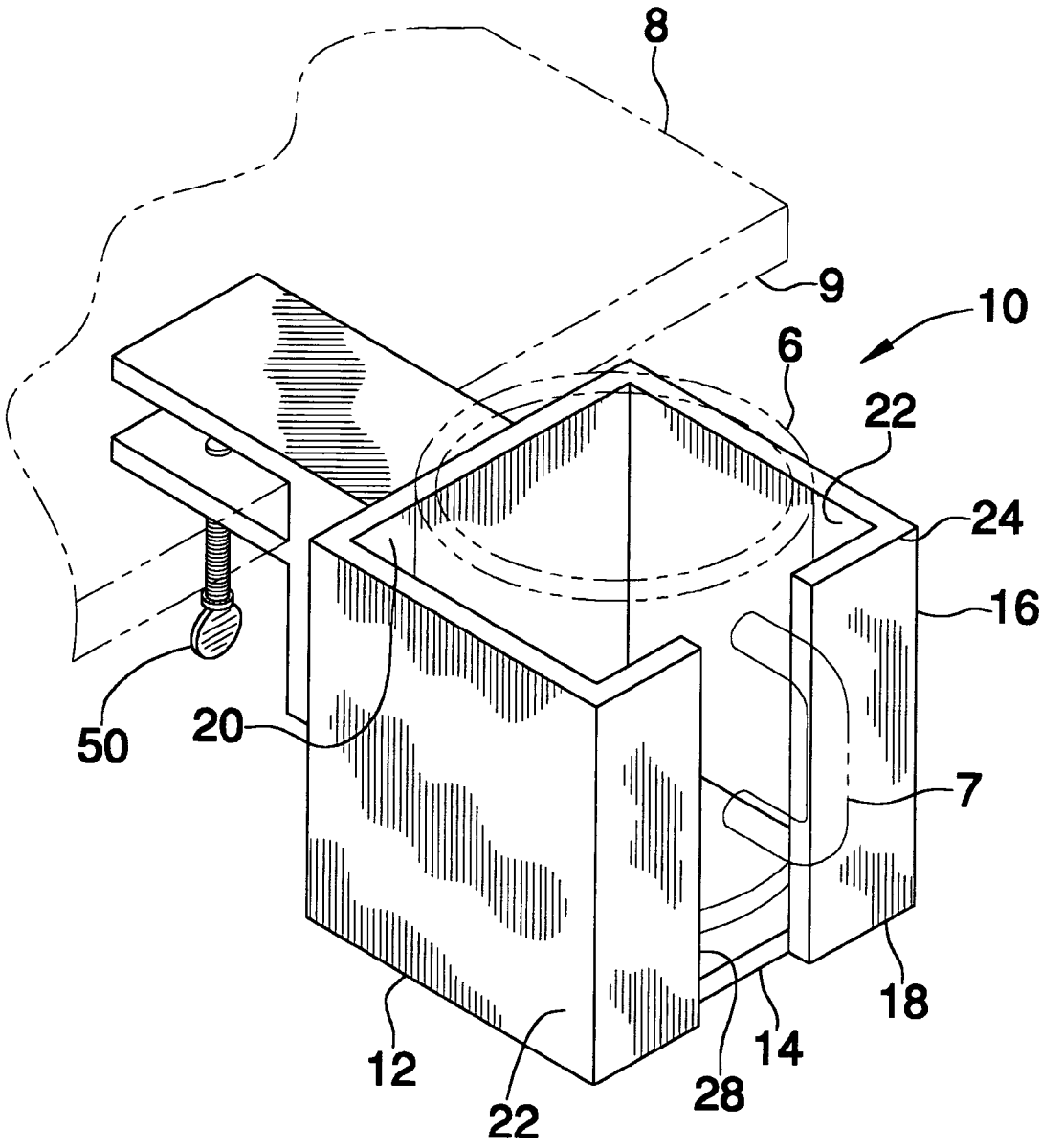
FIG. 1 is a schematic perspective view of a cup holding assembly according to the present invention.
Figure 2:
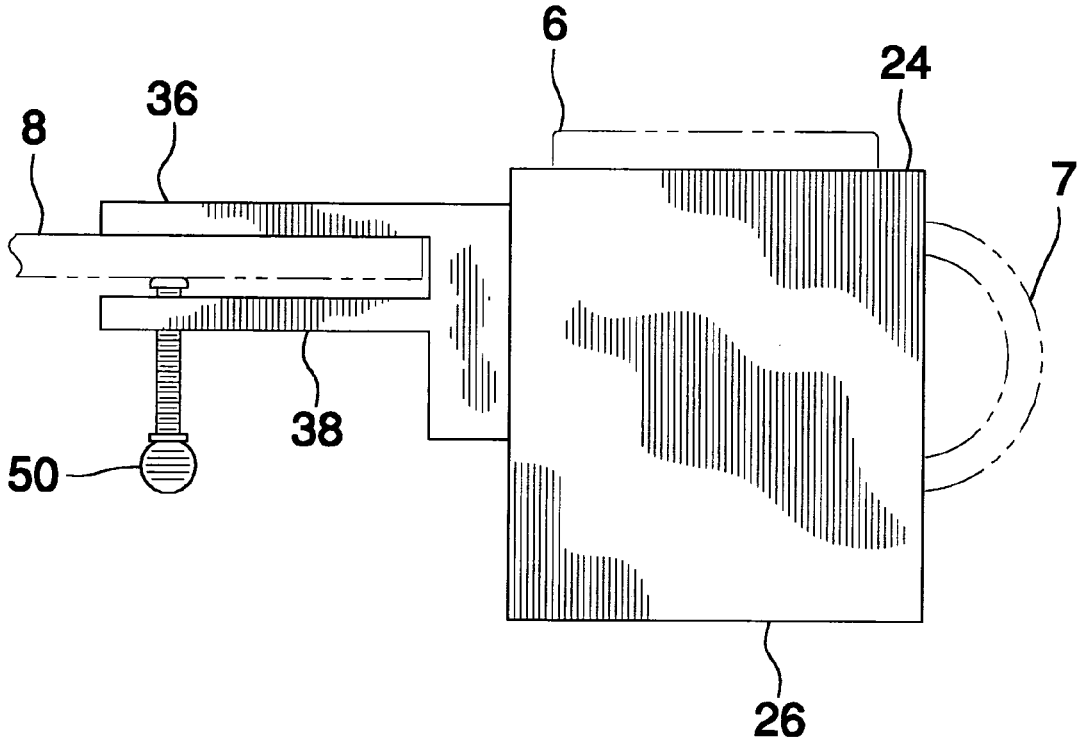
FIG. 2 is a schematic side view of the present invention.
Figure 3:
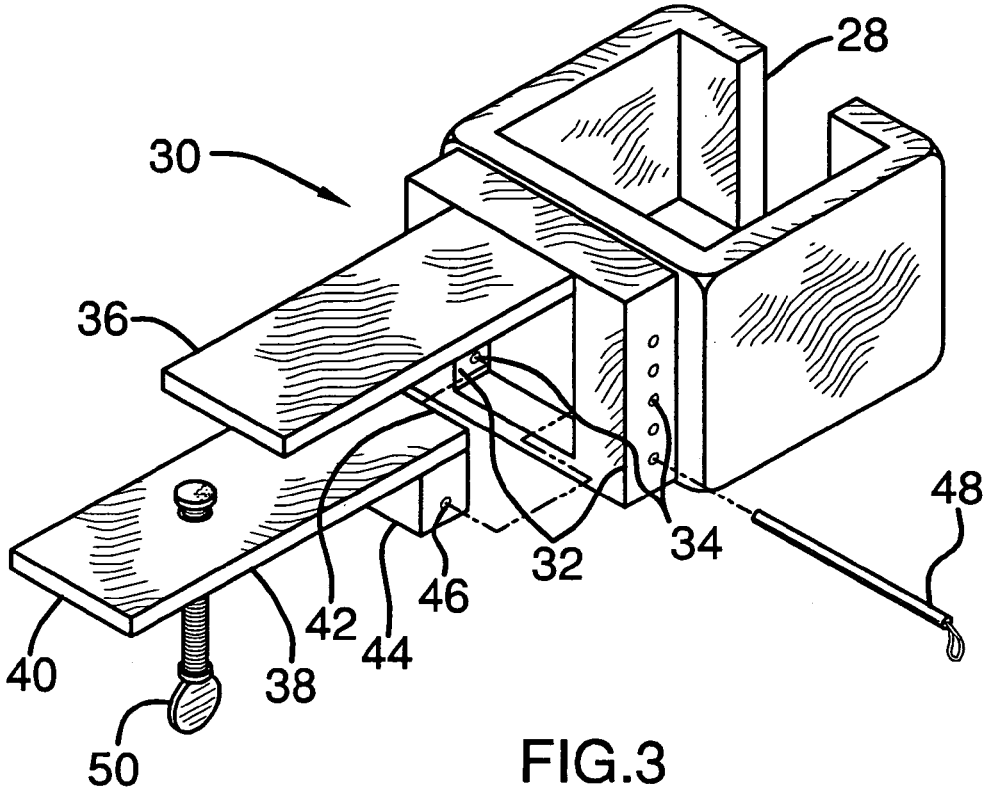
FIG. 3 is a schematic perspective view of the present invention.

With reference now to the drawings, and in particular to FIGS. 1 through 3 thereof, a new cup holding device embodying the principles and concepts of the present invention and generally designated by the reference numeral 10 will be described.

As best illustrated in FIGS. 1 through 3, the cup holding assembly 10 generally comprises a container 12 having a bottom wall 14 and a peripheral wall 16 that is attached to extends upwardly from the bottom wall 14. The peripheral wall 16 includes a front wall 18, a back wall 20, and a pair of lateral walls 22. The peripheral wall 16 has an upper edge 24 and a lower edge 26. The front wall 18 has a vertically orientated break 28 therein extending through the upper 24 and lower 26 edges. The break 28 is positioned for receiving the handle 7 of a coffee cup 6.

A bracket 30 is attached to and extends away from the peripheral wall 16. The bracket 30 is adapted for removably attaching the container 12 to an edge 9 of a tabletop 8. The bracket 30 is positioned on the back wall 20 and is positioned adjacent to the upper edge 24. The bracket 30 includes a pair of posts 32 each attached to the peripheral wall 16 and spaced from each other. Each of the posts 32 is vertically aligned and each of the posts 32 has a plurality of apertures 34 extending therethrough. Each of the apertures 34 in a first of the posts 32 is aligned with one the apertures 34 in a second of the posts 32. A horizontally orientated first panel 36 is attached to and extends away from the back wall 20. The first panel 36 is positioned adjacent to the upper edge 24. A horizontally orientated second panel 38 has a first end 40 and a second end 42. A base 44 is attached to the second panel 38 and is positioned adjacent to and flush with the second end 42. The base 44 has an opening 46 extending therethrough. The base 44 is selectively positioned between the posts 32 such that the opening 46 is aligned with a pair of aligned apertures 34 in the first and second posts 32. A rod 48 is removably extendable through an aligned pair of the apertures 34 and the opening 46 for removably securing the base 44 to the posts 32 such that the first 36 and second 38 panels are orientated parallel to each other. The rod 48 allows the selective positioning of the second panel 38 with respect to the first panel 36. The edge 9 of the tabletop 8 is removably positioned between the first 36 and second 38 panels.

In another embodiment of the bracket 30, shown in FIGS. 1 and 2, the first 36 and second 38 panels are fixed with respect to each other and each is attached to the peripheral wall 30. In both embodiments, the bracket 30 preferably includes a biasing member 50 that is mounted on the second panel 38 for biasing the tabletop 8 away from the second panel 38. The biasing member 50 is preferably a threaded rod which is threadably coupled to the second panel 38 and can be utilized for biasing the tabletop 8 away from the second panel 38 and toward the first panel 36 for securing the tabletop 8 to the bracket 30. Though not needed, the biasing member 50 ensures that the bracket 30 does not slide away from the tabletop 8.

In use, the assembly 10 is attached to a tabletop 8, such as that of a conventional table or desk, to provide a platform for the holding of a coffee cup 6 or other drink container. The assembly 10 removes the coffee cup 6 from the tabletop 8 to prevent spillage and to increase available space on the tabletop 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tabletop cup holder assembly comprising:

a container having a bottom wall and a peripheral wall being attached to extending upwardly from said bottom wall, said peripheral wall including a front wall, a back wall, and a pair of lateral walls, said peripheral wall having an upper edge and a lower edge; and a bracket being attached to and extending away from said peripheral wall, said bracket being adapted for removably attaching said container to an edge of a tabletop, said bracket being positioned on said back wall and being positioned adjacent to said upper edge, said bracket including a first and second panel, each of said first and second panels being horizontally orientated and parallel with respect to each other, the edge of the tabletop adapted to be selectively positioned between the first and second panels, said second panel being selectively positioned with respect to said first panel, a pair of posts being attached to said peripheral wall and being spaced from each other, each of said posts being vertically aligned, each of said posts having a plurality of apertures extending therethrough, each of said apertures in a first of said posts being aligned with one said apertures in a second of said posts, said first panel being attached to and extending away from said back wall, said first panel being positioned adjacent to said upper edge, said second panel having a first end and a second end, a base being attached to said second panel and being positioned adjacent to and flush with said second end, said base having an opening extending therethrough, said base being selectively positioned between said posts such that said opening is aligned with a pair of aligned apertures in said first and second posts, a rod being removably extendable through an aligned pair of said apertures and said opening for removably securing said base to said posts such that said first and second panels are orientated parallel to each other.

2. The assembly according to claim 1, wherein said front wall has a vertically orientated break therein extending through said upper and lower edges.

3. The assembly according to claim 1, wherein said bracket further includes a biasing member being mounted on said second panel for biasing the tabletop away from said second panel.

4. A tabletop cup holder assembly comprising:

a container having a bottom wall and a peripheral wall being attached to extending upwardly from said bottom wall, said peripheral wall including a front wall, a back wall, and a pair of lateral walls, said peripheral wall having an upper edge and a lower edge, said front wall having a vertically orientated break therein extending through said upper and lower edges;

a bracket being attached to and extending away from said peripheral wall, said bracket being adapted for removably attaching said container to an edge of a tabletop, said bracket being positioned on said back wall and being positioned adjacent to said upper edge, said bracket including:

a pair of posts being attached to said peripheral wall and being spaced from each other, each of said posts being vertically aligned, each of said posts having a plurality of apertures extending therethrough, each of said apertures in a first of said posts being aligned with one said apertures in a second of said posts;

a horizontally orientated first panel being attached to and extending away from said back wall, said first panel being positioned adjacent to said upper edge;

a horizontally orientated second panel having a first end and a second end;

a base being attached to said second panel and being positioned adjacent to and flush with said second end, said base having an opening extending therethrough, said base being selectively positioned between said posts such that said opening is aligned with a pair of aligned apertures in said first and second posts;

a rod being removably extendable through an aligned pair of said apertures and said opening for removably securing said base to said posts such that said first and second panels are orientated perpendicular to each other, the edge of the tabletop being removably positioned between the first and second panels; and a biasing member being mounted on said second panel for biasing the tabletop away from said second panel.

* * * * *